US010510272B1

(12) United States Patent
Chen

(10) Patent No.: US 10,510,272 B1
(45) Date of Patent: Dec. 17, 2019

(54) ELECTRONIC SEAL IMPROVEMENT

(71) Applicant: Chih-Chuan Chen, Nantou (TW)

(72) Inventor: Chih-Chuan Chen, Nantou (TW)

( * ) Notice: Subject to any disclaimer, the term of this patent is extended or adjusted under 35 U.S.C. 154(b) by 0 days.

(21) Appl. No.: 16/100,213

(22) Filed: Aug. 10, 2018

(51) Int. Cl.
*G09F 3/03* (2006.01)
*E05B 67/36* (2006.01)
*E05B 39/00* (2006.01)

(52) U.S. Cl.
CPC ..... *G09F 3/0317* (2013.01); *E05B 39/005* (2013.01); *E05B 67/36* (2013.01); *G09F 3/0335* (2013.01)

(58) Field of Classification Search
None
See application file for complete search history.

(56) References Cited

U.S. PATENT DOCUMENTS 6,069,563 A * 5/2000 Kadner ..... G08B 13/06 340/539.1
7,270,353 B2 * 9/2007 Sironi ..... G06K 19/07798 292/307 R
7,298,274 B2 * 11/2007 Chen ..... G09F 3/0376 29/282
7,828,342 B2 * 11/2010 Terry ..... E05B 39/02 292/307 R
8,207,848 B2 * 6/2012 Berger ..... G08B 13/08 340/542
8,319,647 B2 * 11/2012 Chen ..... E05B 39/005 29/282
8,508,371 B2 * 8/2013 Lee ..... H01Q 1/2208 340/10.1
8,558,700 B2 * 10/2013 Chen ..... G09F 3/0317 29/282
8,666,664 B2 * 3/2014 Chiu ..... G08B 13/06 340/426.24
8,742,931 B2 * 6/2014 Lee ..... G06K 19/07798 340/572.1
8,866,609 B2 * 10/2014 Chen ..... G06K 19/0775 340/539.13
9,508,271 B2 * 11/2016 Chen ..... G09F 3/0317
2003/0189491 A1 * 10/2003 Ng ..... G06K 19/04 340/572.9

* cited by examiner

*Primary Examiner* — John F Mortell
(74) *Attorney, Agent, or Firm* — Leong C. Lei

(57) ABSTRACT

The present invention consists of a plug bolt and a bolt seat. The plug bolt comprises a conductor and a circuit board; the conductor has a first stuck-buckle, an accommodation-hole, and a top-cover; the circuit board is set with an RFID chip, an upper contact point, and a lower contact point. The RFID chip forms a first far-field antenna loop through the first pin, the upper contact point, the top-cover, and the conductor. The bolt seat is equipped with an elastic device, an internal antenna, an inserting-hole, and a second stuck-buckle, thereby controlling the elastic device to provide a pre-pressure to the internal antenna to electrically connect with the lower contact point. When the RFID chip is activated, the internal antenna forms a second far-field antenna loop and synchronously activate the first one; which the first and second far-field antenna loops can be cut-off when the top-cover is worn.

15 Claims, 9 Drawing Sheets

ELECTRONIC SEAL IMPROVEMENT

(a) TECHNICAL FIELD OF THE INVENTION

The present invention especially relates to the technical field in which the electromagnetic wave output can be completely cut off when a thief breaks the electronic seal.

(b) DESCRIPTION OF THE PRIOR ART

U.S. Pat. No. 9,508,271 "Electronic bolt seal" patent is for better receiving distance, which is simultaneously configuring with the Near-Field Antenna (NFA) and the Far-Field Antenna (FFA) as shown in FIG. 1; the circuit board 90 of this patent is set with an upper contact point 91, a lower contact point 92, and a RFID chip 93 are disposed; wherein a connecting wire 94 is bridged between the upper contact point 91 and the RFID chip 93.

And, a U-shaped near-field antenna 95 is set between the lower contact point 92 and the RFID chip 93. The RFID chip 93 is bridged to the feeding portion of the near-field antenna 95 for normally closing the near-field antenna 95 to maintain switching on. When the upper contact point 91 is electrically connected to the conductor and the lower contact point 92 is electrically connected to the internal antenna in the bolt seat, the operation of the far-field antenna circuit loop can be constructed.

In this patent case, after the thief grinds the top end of the plug bolt, the circuit board 90 will cut off the said far-field antenna circuit loop. However, the near-field antenna circuit loop can still continuously emit electromagnetic waves, which will cause the identification hosts of the customs to misjudge.

SUMMARY OF THE INVENTION

The main content of the present invention is to provide an electronic seal that overcomes the defects of U.S. Pat. No. 9,508,271 patent.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Figure 1:
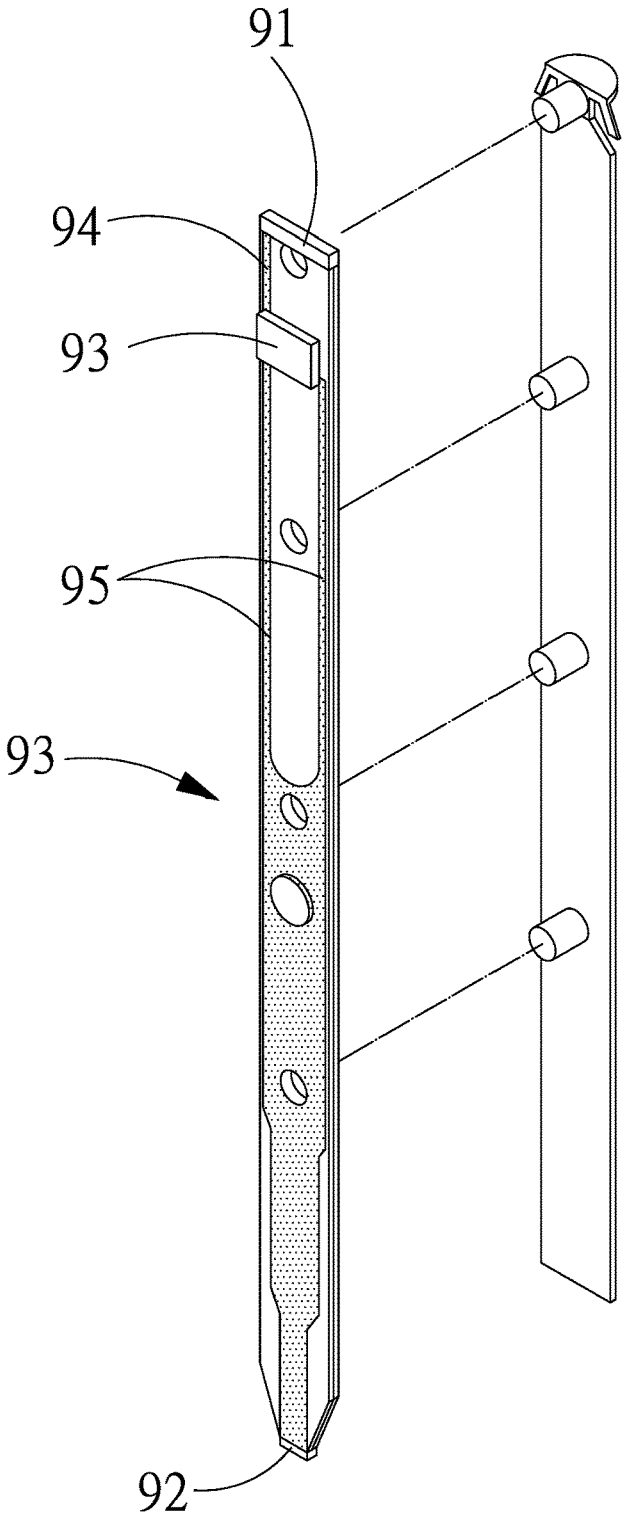
PRIOR ART FIG. 1
FIG. 1 is a schematic diagram of the circuit board of the U.S. Pat. No. 9,508,271 patent.
Figure 2:
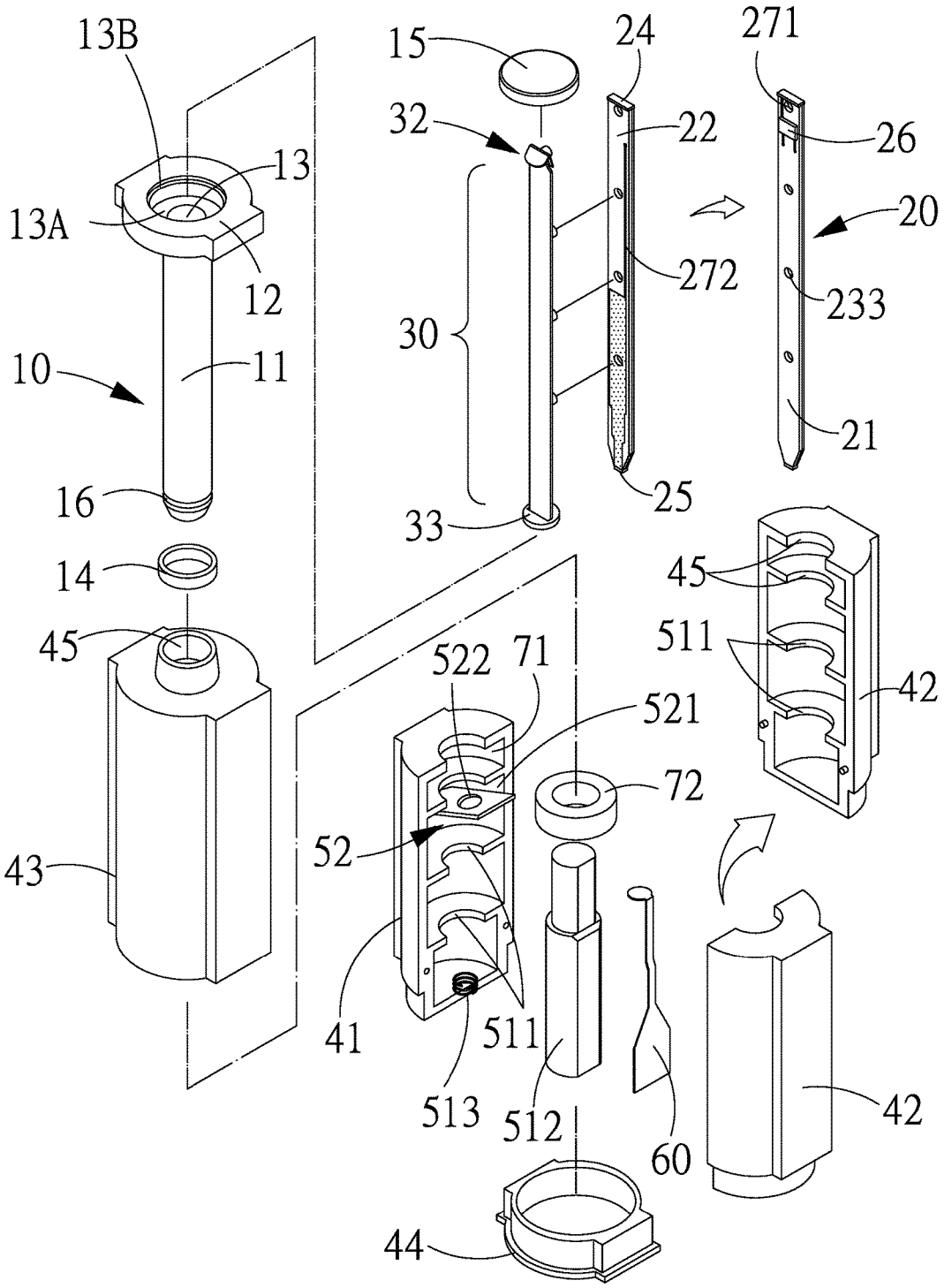
FIG. 2 is an exploded schematic diagram of the present invention.
Figure 3:
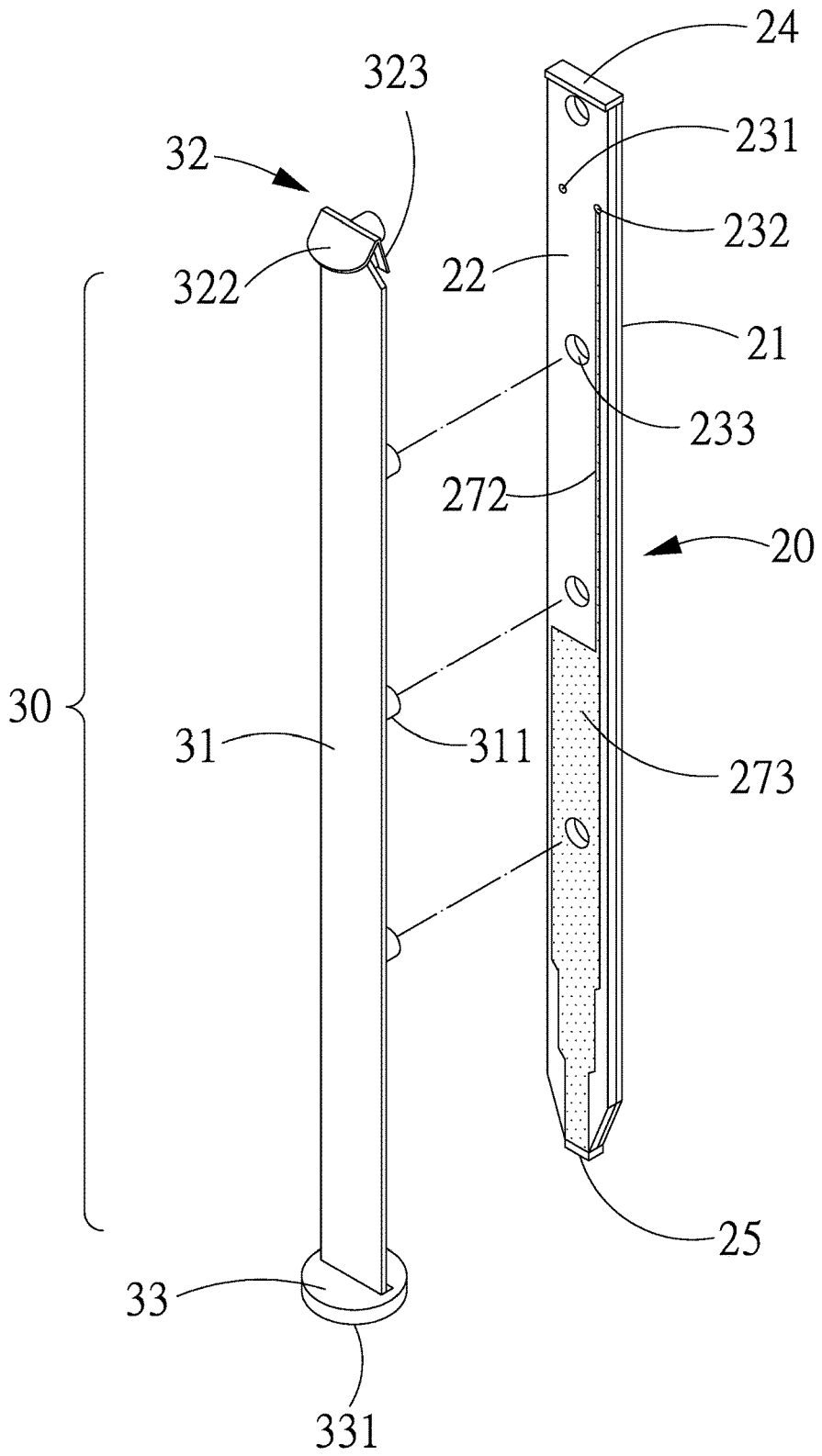
FIG. 3 and FIG. 4 are the exploded schematic diagrams of the circuit board and the upper pre-pressing portion of the present invention.
Figure 4:
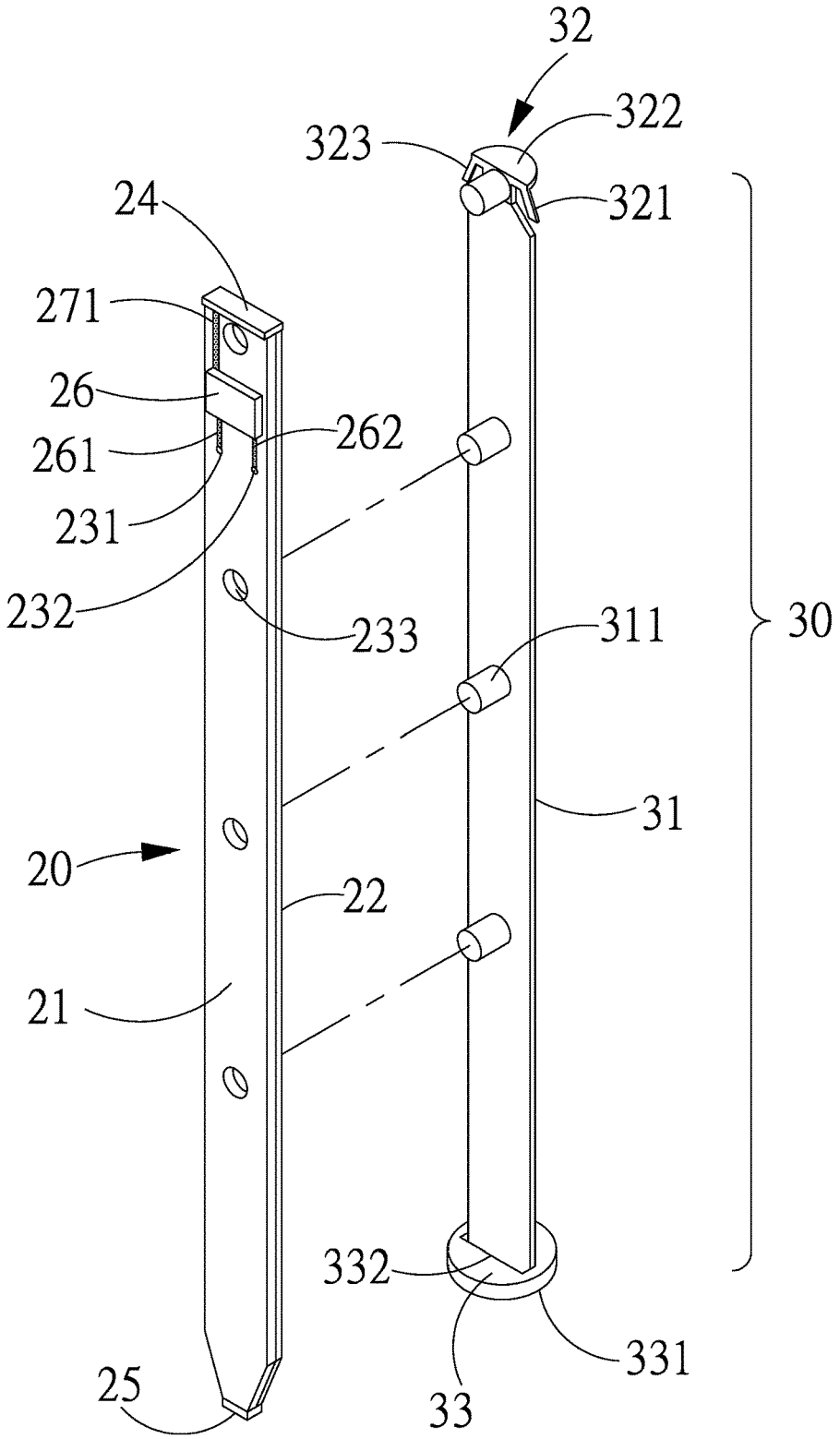
Figure 5:
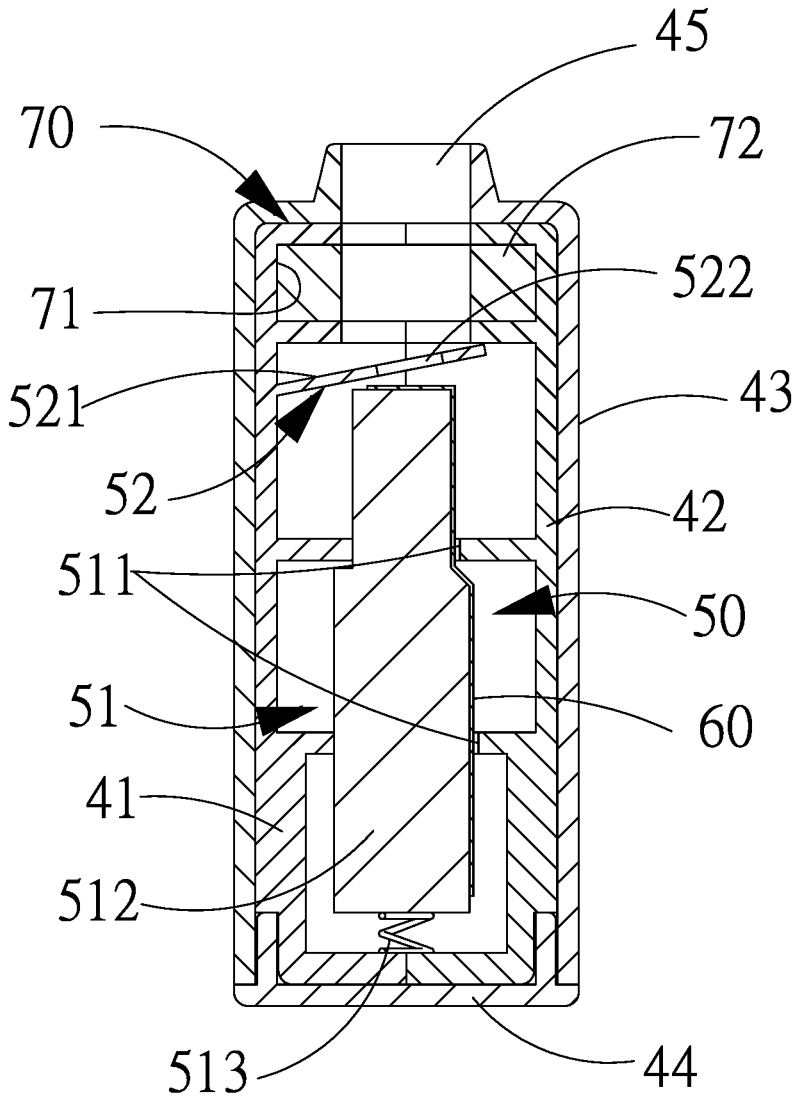
FIG. 5 is a sectional schematic diagram of the bolt seat of the present invention.
Figure 6:
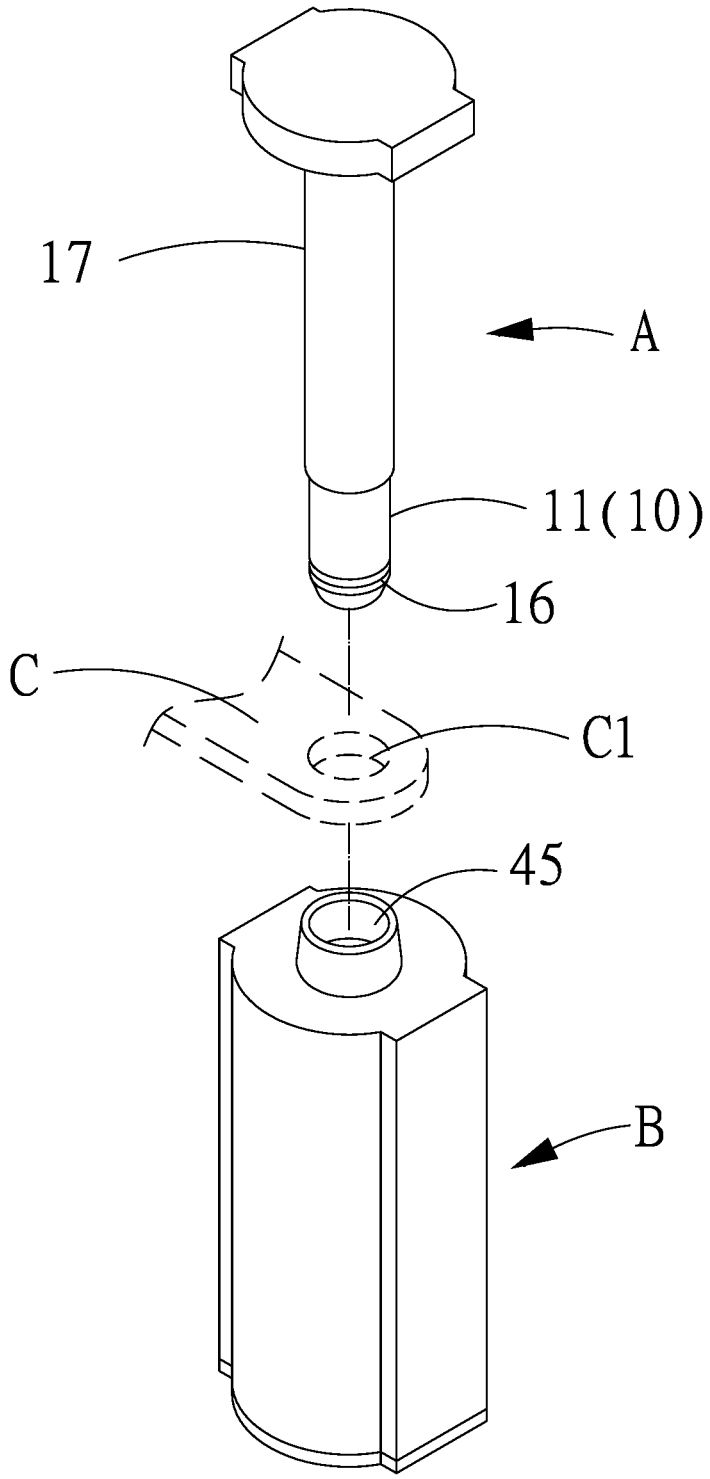
FIG. 6 is a schematic diagram showing the relative positions of the plug bolt, cargo container door-bolt, and the bolt seat of the present invention.
Figure 7:
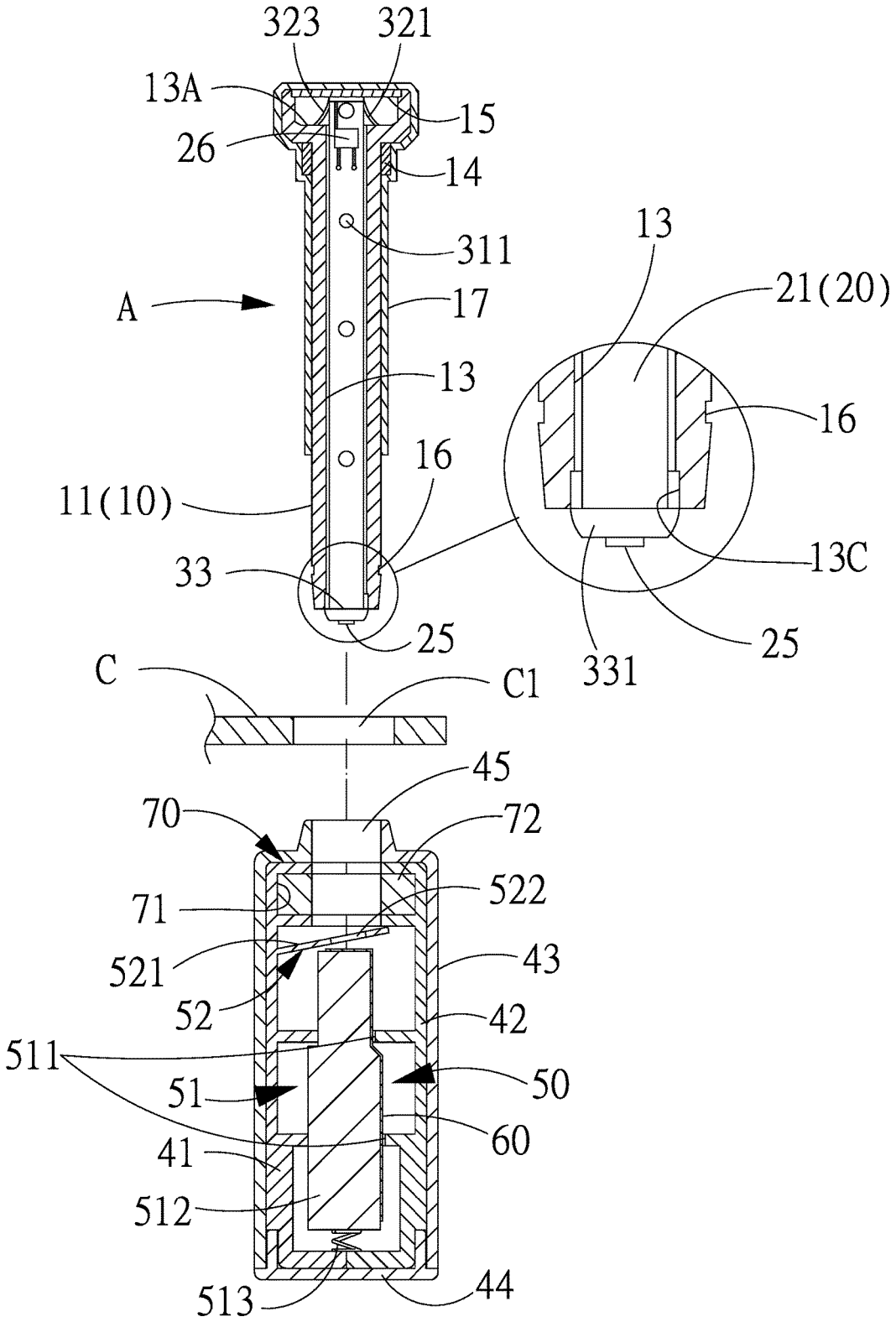
FIG. 7 is a cross-sectional schematic diagram of FIG. 6 of the present invention.
Figure 9:
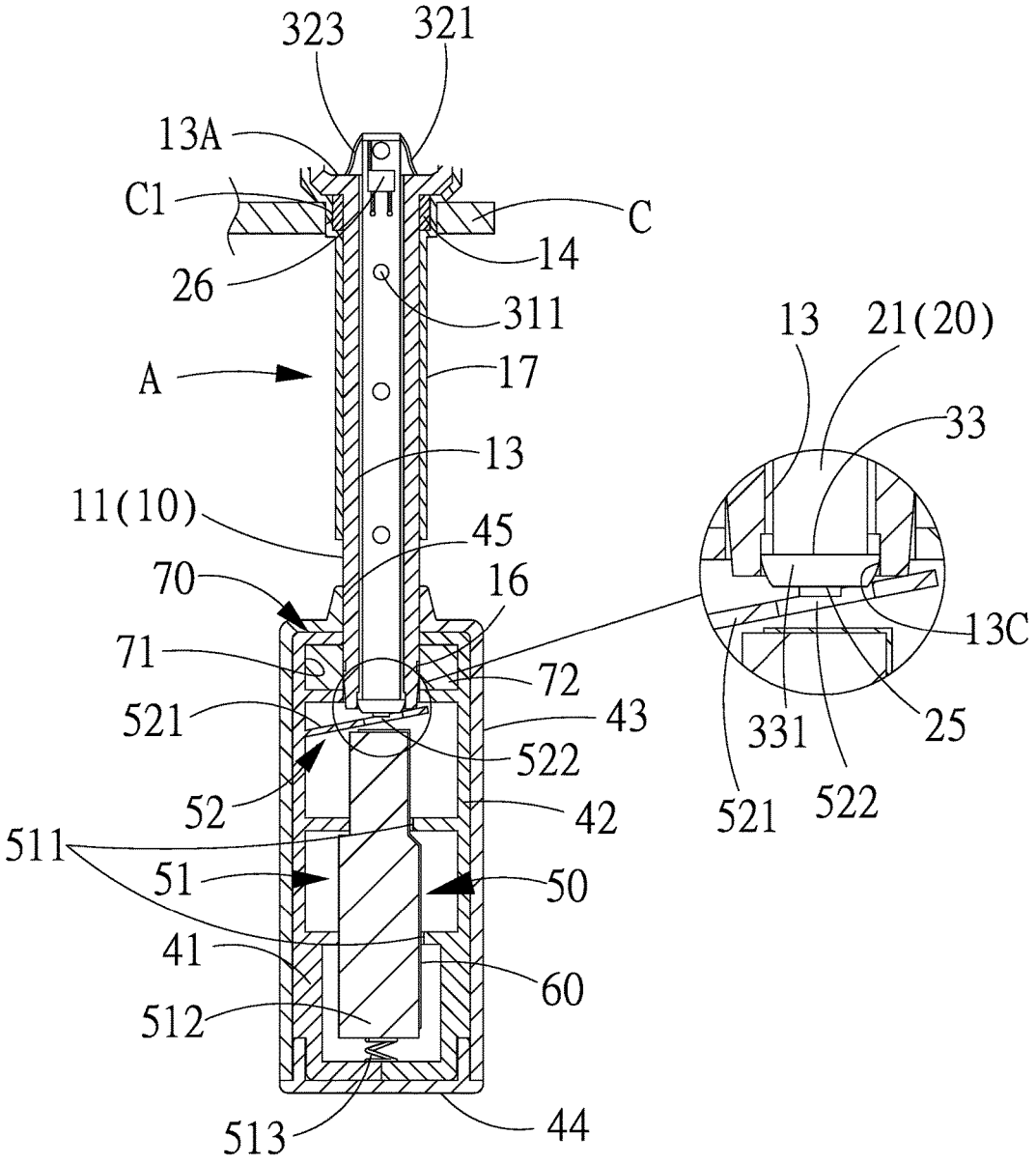
FIG. 9 is a schematic cross-sectional combination diagram after the thief has grinded the top of the plug bolt of the present invention.

Please refer FIG. 6 and FIG. 9, the electronic seal of the present invention is composed of a plug bolt A and a bolt seat B. The plug bolt A can be serially plug and engaged into the bolt-hole C1 and bolt seat B of the door-bolt C of the cargo container downwardly to lock the cargo container, and for the customs identification hosts to determine whether the cargo container is opened normally.

Please refer FIG. 2 to FIG. 7, the plug bolt A is mainly composed of a metal conductor 10, a circuit board 20 and an upper pre-pressing portion 30; the technical details are described as follows.

The conductor 10 has a rod-body 11, a hat-head 12 radially outwardly extending from the top end of the rod-body 11, an axially penetrated accommodation-hole 13, and a jacket-ring 14 abutting the bottom end of the hat-head 12; wherein the hat-head 12 has a diameter sufficient to abut against the door-bolt C, and the top edge of the accommodation-hole 13 has head-cave 13A with a larger diameter, and the top edge of the head-cave 13A has a cover-cave 13B with a more larger diameter; wherein the bottom edge of the accommodation-hole 13 is set with a sink-cave 13C having a larger inner diameter; wherein the cover-cave 13B is set for being closed by a conductive top-cover 15; wherein the rod-body 11 is recessedly set with a first stuck-buckle 16 at the outer peripheral ring of the lower portion, and the outer periphery of the upper portion of the conductor 10 is set with an insulating sleeve 17 to cover the jacket-ring 14 and the top-cover 15.

The circuit board 20 is suspended from the accommodation-hole 13 through the upper pre-pressing portion 30 and has a first surface 21 and a second surface 22 opposite to each other; and is further set with a first hole 231, a second hole 232, and a plurality of third holes 233 to penetrate through the first surface 21 and the second surface 22; wherein the upper end of the circuit board 20 is further set with an upper contact point 24 and the bottom end is set with a lower contact point 25, and a RFID chip 26 is further installed on the first surface 21 of the circuit board 20; wherein the RFID chip 26 has a first pin 261 that can be positioned on the first hole 231 and a second pin 262 that is positioned on the second hole 232. The first pin 261 and the second pin 262 of the RFID chip 26 are normally maintaining open contact point (normally Open); wherein the first surface 21 bridges a first connecting wire 271 between the first pin 261 and the upper contact point 23, and the second surface 22 bridges a second connecting wire 272 between the lower contact point 25 and the second pin 262; wherein the RFID chip 26 is crossly connected to the feeding portion of the first connecting wire 271 and the second connecting wire 272, which the first connecting wire 271 and the second connecting wire 272 are not electrically connected to each other. The upper pre-pressing portion 30 is composed of an insulating plate 31 set with a connecting pillar 311 for mounting the third hole 233 of the circuit board 20, and the insulating plate 31 is flatly attached to the second surface 22 of the circuit board 20; then, the inside and outside of the second connecting wire 272 are insulated, so that the second connecting wire 272 will not short-circuit with the conductor 10; further, the insulating plate 31 is set with a first head-cave 13A that can be suspended from the head hole 13A and a second buckle-portion 33 that can enter and exit the sink-cave 13C.

The first buckle-piece 32 has a fork-shaped elastic pieces 321, 322, 323 extend downwardly to abut against the bottom end of the head-cave 13A and drive the upper contact point 24 to abut against the bottom surface of the top-cover 15; and the conductor 10 and the RFID chip 26 constitute a first far-field antenna circuit loop that cannot output power; at the same time, the lower contact point 25 is in a position protruding downwardly from the sink-cave 13C; please corporately refer FIGS. 2, 3, 4, 8, and 9; the second buckle-portion 33 is radially protrudedly set from the bottom end of the insulating plate 31, which has a guiding surface 331 whose outer diameter is tapered downwardly and has a slot 332 penetrating through the upper and lower sides to make the circuit board 20 pass through; wherein the lower contact point 25 slightly protrudes from the bottom surface of the second buckle-portion 33 and the top outer diameter of the second buckle-portion 33 is between the sink-cave 13C and the aperture of the accommodation-hole 13; and controls the upper contact point 24 to electrically connect with the bottom surface of the top-cover 15, which the lower portion of the second buckle-portion 33 protrudes from the bottom end of the sink-cave 13C; and when the top-cover 15 is disengaged, it can drive the top of the second buckle-portion 33 to slide upward along the sink-cave 13C through releasing the first buckle-portion 32, so that the insulating plate 31 and the circuit board 20 cannot be pulled out from the top of the accommodation-hole 13; further, the lower contact point 25 will collapse upward by a distance, thereby synchronously cut off the second far-field antenna circuit loop formed by the second connecting wire 272, the RFID chip 26, and the internal antenna 52 which will be described later.

The bolt seat B is engaged by the first shell-body 41 and the second shell-body 41 and then placed in a outer-shell 43, and closed by a bottom-cover 44 to close the bottom end of the outer-shell 43 to compose; wherein the bolt seat B is set with an inserting-hole 45 for the lower portion of the conductor 10 to insert at the upper portion, and an elastic device 50 and an internal antenna 60 are set inside the bolt seat B; wherein the elastic device 50 is composed of a first unit 51 and a second unit 52; wherein the first unit 51 comprises a stepping-hole 511, a sliding-block 512 and a spring 513, which the stepping-hole 511 is coaxially communicated directly below the inserting-hole 45; wherein the sliding-block 512 can slide along the top dead point to the bottom dead point of the stepping-hole 511, and the spring 513 is mounted between the bottom end of the sliding-block 512 and the bottom end of the stepping-hole 511 to push the sliding-block 512 to position at the top dead point; wherein the internal antenna 60 is coupled to the top and outer periphery of the sliding-block 512; wherein the second unit 52 is one-body integrally formed with a spring-piece 521 on the first shell-body 41, which the spring-piece 521 is obliquely disposed between the upper position of the sliding-block 512 and the lower position of the inserting-hole 45 and penetrated with a guiding-hole 522; when the lower portion of the conductor 10 is inserted into the inserting-hole 45, the lower contact point 25 of the plug bolt A corresponding to the guiding-hole 522 of the conductor 10 can pass through, and further control the guiding surface 331 of the second buckle-portion 33 cannot pass through the guiding-hole 522, so that the spring-piece 521 is deformable to provide a negative pre-pressure to the plug bolt A.

The bolt seat B is further set with a second stuck-buckle 70 which is radially expanded outside the inserting-hole 45 to set with a ring-groove 71, and the ring-groove 71 is installed with a buckle-ring 72; wherein the lower contact point 25 is pass through the guiding-hole 522 to force the internal antenna 60 and the sliding-block 512 to downwardly move a predetermined stroke when the bottom end of the plug bolt A is downwardly inserted into the cargo bolt-hole C1 and the inserting-hole 45 from the top to the bottom; then, the first stuck-buckle 16 is positioned at the second stuck-buckle 70, so that the electronic seal can be operated to lock the door-bolt C of the cargo container; at this time, the first unit 51 can provide a positive pre-pressure to the internal antenna 60 to electrically connect with the lower contact 25.

The RFID chip 26 and the internal antenna 60 can form a second far-field antenna circuit loop, which can cause the first and second far-field antenna circuit loops to be synchronously activated to transmit and receive the electromagnetic waves to provide automated management of the customs identification hosts. In addition, the foregoing second unit 52 can apply a negative pre-pressure to the plug bolt A before the second stuck-buckle 70 is positioned at the first stuck-buckle 16.

Figure 8:
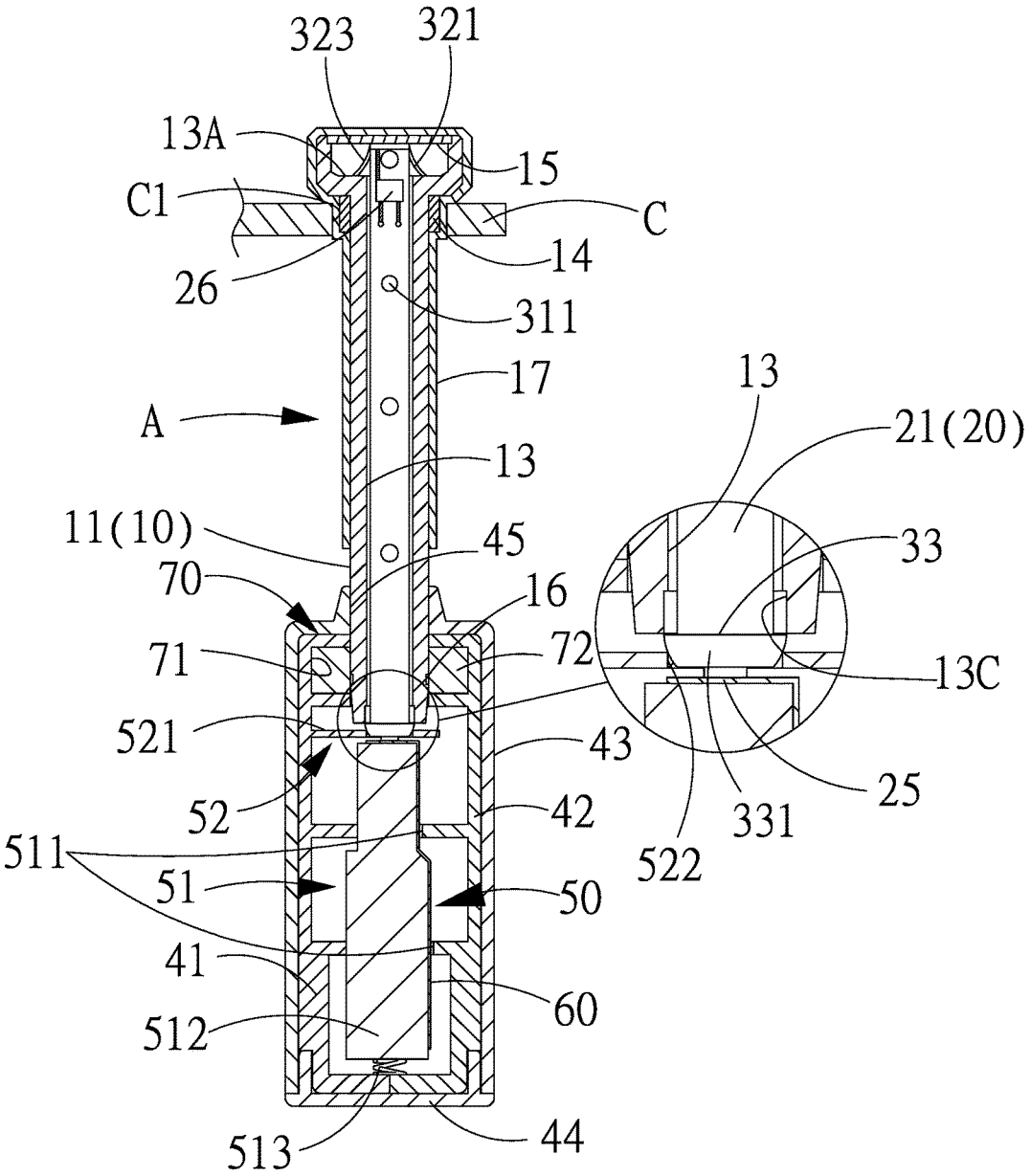
FIG. 8 is a schematic cross-sectional combination diagram showing the first and second stuck-buckle after positioning of the present invention.

As shown in FIG. 8 and FIG. 9, when the thief grinds the diameter of the hat-head 12 of the plug bolt A to less than the bolt-hole C1 by the grinder, the top-cover 15 is disengaged, thereby interrupting the foregoing first far-field antenna circuit loop. In addition, the high temperature is generated during the destruction of the top-cover 15 by the grinder, which will impair the elasticity and shape of the first buckle-piece 32. Under the negative pre-pressure of the plug bolt A by the second unit 52, it can be assured that the lower contact point 25 cannot be electrically connected with the bolt seat B and the internal antenna 60; thereby completely cutting off the second far-field antenna circuit loop, so that the misjudgment problem of the U.S. Pat. No. 9,508,271 patent can be removed by the present invention. Furthermore, the first far-field antenna circuit loop and the second far-field antenna circuit loop form an asymmetric antenna configuration, and the output power of the second far-field antenna circuit loop is controlled to be greater than the output power of the first far-field antenna circuit loop, so as to assure that the first far-field antenna circuit loop and the second far-field antenna circuit loop will also be cut off simultaneously when the conductor 10 is cut off.

I claim:

1. An electronic seal improvement, which at least comprises:

a plug bolt, which is composed of a conductor and a circuit board; wherein the conductor has an accommodation-hole with an opening facing downward and a top end thereof is closed by a top-cover; wherein a first stuck-buckle is set in a lower portion of the conductor;

wherein the circuit board is mounted on the accommodation-hole and set with an RFID chip, and is further set with an upper contact point matching with the top-cover and a lower contact point protruding a bottom end of the accommodation-hole;

wherein the RFID chip is connected out to form a first pin and a second pin;

wherein a first far-field antenna circuit loop is formed by the RFID chip through the first pin, the upper contact point, the top-cover, and the conductor;

wherein the second pin is electrically connected with the lower contact point; and a bolt seat set with an elastic device and an internal antenna, and an inserting-hole provided for inserting a lower portion of the conductor;

wherein the bolt seat is further set with a second stuck-buckle for positioning the first stuck-buckle, so as to control the elastic device to provide pre-pressure to the internal antenna to electrically connect with the lower contact point and to activate the RFID chip and the internal antenna to form a second far-field antenna circuit loop;

wherein the first far-field antenna circuit loop is synchronously activated, and the first far-field antenna circuit loop and the second far-field antenna circuit loop can be simultaneously cut off when the top-cover is disengaged.

2. The electronic seal improvement according to claim 1, wherein the first far-field antenna circuit loop and the second far-field antenna circuit loop form an asymmetric antenna configuration, and an output power of the second far-field antenna circuit loop is controlled to be greater than the output power of the first far-field antenna circuit loop, so as to assure that the first far-field antenna circuit loop and the second far-field antenna circuit loop will also be cut off simultaneously when the conductor 10 is cut off.

3. The electronic seal improvement according to claim 2, wherein the first pin and the second pin of the RFID chip are normally maintaining open contact point (normally Open).

4. The electronic seal improvement according to claim 1, wherein the elastic device is composed of a first unit and a second unit; when the first and second far-field antenna circuit loops are activated, the first unit provides a positive pre-pressure required for electrical connection between the internal antenna and the lower contact point; but when the top-cover is worn out, the second unit can provide a negative pre-pressure required for the lower contact point to disengage from the internal antenna.

5. The electronic seal improvement according to claim 2, wherein the elastic device is composed of a first unit and a second unit; when the first and second far-field antenna circuit loops are activated, the first unit provides a positive pre-pressure required for electrical connection between the internal antenna and the lower contact point; but when the top-cover is worn out, the second unit can provide a negative pre-pressure required for the lower contact point to disengage from the internal antenna.

6. The electronic seal improvement according to claim 3, wherein the elastic device is composed of a first unit and a second unit; when the first and second far-field antenna circuit loops are activated, the first unit provides a positive pre-pressure required for electrical connection between the internal antenna and the lower contact point; but when the top-cover is worn out, the second unit can provide a negative pre-pressure required for the lower contact point to disengage from the internal antenna.

7. The electronic seal improvement according to claim 4, wherein the second unit is set with a spring-piece inside the bolt seat, and the spring-piece is located between an upper position of the internal antenna and a lower position of the inserting-hole, and is penetrated and set a guiding-hole; wherein the guiding-hole can provide the lower contact point to pass through, but cannot provide the bottom end of the conductor to pass through when the first stuck-buckle and the second stuck-buckle are positioned, so that the bottom end of the conductor can push the spring-piece to deform and provide a negative pre-pressure to the bottom end of the conductor.

8. The electronic seal improvement according to claim 5, wherein the second unit is set with a spring-piece inside the bolt seat, and the spring-piece is located between an upper position of the internal antenna and a lower position of the inserting-hole, and is penetrated and set a guiding-hole; wherein the guiding-hole can provide the lower contact point to pass through, but cannot provide the bottom end of the conductor to pass through when the first stuck-buckle and the second stuck-buckle are positioned, so that the bottom end of the conductor can push the spring-piece to deform and provide a negative pre-pressure to the bottom end of the conductor.

9. The electronic seal improvement according to claim 6, wherein the second unit is set with a spring-piece inside the bolt seat, and the spring-piece is located between an upper position of the internal antenna and a lower position of the inserting-hole, and is penetrated and set a guiding-hole; wherein the guiding-hole can provide the lower contact point to pass through, but cannot provide the bottom end of the conductor to pass through when the first stuck-buckle and the second stuck-buckle are positioned, so that the bottom end of the conductor can push the spring-piece to deform and provide a negative pre-pressure to the bottom end of the conductor.

10. The electronic seal improvement according to claim 1, wherein the circuit board bridges a first connecting wire between the first pin and the upper contact point, and bridges a second connecting wire between the second pin and the lower contact point.

11. The electronic seal improvement according to claim 2, wherein the circuit board bridges a first connecting wire between the first pin and the upper contact point, and bridges a second connecting wire between the second pin and the lower contact point.

12. The electronic seal improvement according to claim 3, wherein the circuit board bridges a first connecting wire between the first pin and the upper contact point, and bridges a second connecting wire between the second pin and the lower contact point.

13. The electronic seal improvement according to claim 10, wherein the circuit board has a first surface and a second surface opposite to each other, and is spacedly set with a first hole and a second hole penetrating through the first surface and the second surface; wherein the RFID chip is mounted on the first surface; wherein the first pin is positioned at the first hole and the second pin is positioned at the second hole; wherein the first surface is set with a first connecting wire between the first pin and the upper contact point, and the second surface is set with a second connecting wire between the second pin and the lower contact point; wherein the circuit board is mounted on the accommodation-hole through an insulating plate which is combined and set on the second surface of the circuit board to isolate the second connecting wire.

14. The electronic seal improvement according to claim 11, wherein the circuit board has a first surface and a second surface opposite to each other, and is spacedly set with a first hole and a second hole penetrating through the first surface and the second surface; wherein the RFID chip is mounted on the first surface; wherein the first pin is positioned at the first hole and the second pin is positioned at the second hole; wherein the first surface is set with a first connecting wire between the first pin and the upper contact point, and the second surface is set with a second connecting wire between the second pin and the lower contact point; wherein the circuit board is mounted on the accommodation-hole through an insulating plate which is combined and set on the second surface of the circuit board to isolate the second connecting wire.

15. The electronic seal improvement according to claim 12, wherein the circuit board has a first surface and a second surface opposite to each other, and is spacedly set with a first hole and a second hole penetrating through the first surface and the second surface; wherein the RFID chip is mounted on the first surface; wherein the first pin is positioned at the first hole and the second pin is positioned at the second hole; wherein the first surface is set with a first connecting wire between the first pin and the upper contact point, and the second surface is set with a second connecting wire between the second pin and the lower contact point; wherein the circuit board is mounted on the accommodation-hole through an insulating plate which is combined and set on the second surface of the circuit board to isolate the second connecting wire.

* * * * *